United States Patent [19]

Rösler et al.

[11] 4,428,267

[45] Jan. 31, 1984

[54] DIGITAL SEMICONDUCTOR CIRCUIT FOR AN ELECTRONIC ORGAN

[75] Inventors: Helmut Rösler; Otto Mühlbauer, both of Munich; Josef Dempf, Kloster-Lechfeld; Klaus-Dieter Bigall, Vaterstetten, all of Fed. Rep. of Germany

[73] Assignee: Siemens Aktiengesellschaft, Berlin and Munich, Fed. Rep. of Germany

[21] Appl. No.: 277,892

[22] Filed: Jun. 26, 1981

[30] Foreign Application Priority Data

Jul. 1, 1980 [DE] Fed. Rep. of Germany ..... 3024931

[51] Int. Cl.[3] ..... G10H 1/00

[52] U.S. Cl. ..... 84/1.01; 84/445; 84/DIG. 23

[58] Field of Search ..... 84/1.01, 445, 454, DIG. 23, 84/DIG. 22

[56] References Cited

U.S. PATENT DOCUMENTS

| | | | |
|---|---|---|---|
| 4,055,103 | 10/1977 | Machanian | 84/DIG. 23 |
| 4,059,039 | 11/1977 | Carlson | 84/1.01 |
| 4,083,286 | 4/1978 | Faulkner | 84/1.01 |
| 4,108,038 | 8/1978 | Aoki | 84/DIG. 23 |
| 4,204,453 | 5/1980 | Gross | 84/DIG. 22 |
| 4,319,511 | 3/1982 | Kato et al. | 84/1.01 |

*Primary Examiner*—F. W. Isen

*Attorney, Agent, or Firm*—Herbert L. Lerner; Laurence A. Greenberg

[57] ABSTRACT

A digital semiconductor circuit for an electronic organ has a plurality of control inputs addressed via a keyboard and corresponding in number to the number of keys of the organ keyboard, and a plurality of audiofrequency signal inputs addressed with periodic electrical oscillations by an oscillator system. Each control input is associated with a respective key of the keyboard and each audiofrequency signal input is permanently assigned with a respective tone frequency of the highest octave of the organ. The control signals serve to address the control inputs by the keys of the keyboard corresponding to logical levels "1" and "0." The circuit further includes a number t of divider stages in a frequency divider at least equal to a number q of the octaves in the organ keyboard. A number u of a plurality of AND gates in a given group of AND gates is greater than the number q of the octaves in the organ keyboard. All of the AND gates of the given group have signal inputs, and at least one setting input is connectible via a switch to the logical level "1" by an individual playing the organ so as to address the signal inputs of these AND gates.

6 Claims, 3 Drawing Figures

DIGITAL SEMICONDUCTOR CIRCUIT FOR AN ELECTRONIC ORGAN

In U.S. Pat. No. 4,357,853 dated Nov. 9, 1982, of which applicants are coinventors and which is incorporated by reference herein, a digital semiconductor circuit for an electronic organ with a number of control inputs addressed by the keyboard corresponding to the number of keys on the keyboard of the organ as well as with the number of audio signal inputs addressed by an oscillator system with periodic electrical oscillations is described, in which each control input is permanently assigned to a key of the keyboard and each audio signal input to a tone frequency, in which, furthermore, an audio signal output for addressing an electroacoustic transducer is provided and in which, finally, the control signals serving for addressing the control inputs correspond to the logic levels "1" and "0."

It is a characteristic of the circuit described in the aforementioned co-pending application that the individual control inputs are assigned to a respective cell of a clock-controlled shift register which is operated as a parallel-series converter; that the signal output of the shift register as well as the clock pulses provided for the operation thereof furthermore serve for controlling a switching system, which is, on the other hand, provided with the totality of the provided audio signal inputs; that, furthermore, the number of audio signal outputs is lower than the number of control inputs, as well as each of the audio signal outputs having an amplitude controller assigned thereto; and that, finally, the outputs of the amplitude controllers are connected to an electroacoustic transducer.

It appears appropriate, initially to present the parts of the circuit described in the aforementioned co-pending application which are essential for the invention of the instant application, referring to FIG. 1 herein.

A depressed key in the keyboard M of the organ generates a "1" at the control input E of the semiconductor circuit which is individually assigned thereto, while the control input E, which is assigned to a non-operated key, retains the level "0." By a clock generator TG, a shift register PSW is supplied with the clock pulses required for reading out the information formed between the individual interrogation cycles in the shift register PSW. The information in the shift register PSW is fed from the individual keys of the keyboard M, via the control input E assigned to the respective key, to a respective storage cell provided in the shift register PSW. The sequence of the keys in the keyboard M corresponds to the sequence of the storage cells assigned to the individual keys in the shift register PSW.

The information periodically shifted out of the shift register PSW is delivered to a common switching system, the input of which is formed by a so-called channel selector KW. From the channel selector KW, which is described in detail in the aforementioned co-pending application, a number of identical branches extend, each of which represents an audio channel identified by $V_1$ and $V_2$, respectively, and so forth i.e. generally by $V_i$, depending upon the number 1, 2 and so forth thereof. The respective value of the subscript "i" indicates the number of the channel in question or of the amplitude former $AF_i$ associated therewith. The outputs of the channels $V_i$ serving to drive the individual amplitude controllers $AF_i$ are identified by reference character $AU_i$, and the output of the corresponding amplitude controller $AF_i$ by reference character $AG_i$.

Each of the output channels $V_i$ is provided with the required digital information, on the one hand via the channel selector KW, on the other hand by a tone signal generator TOS and, finally, by a tone address counter TAZ. This tone address counter takes over the shift pulses, during the individual interrogation cycles, as counting pulses for shifting the information out of the input shift register PSW.

The tone address counter TAZ is formed of two parts. The first part, in turn, is formed of four series-connected binary counting stages which are connected in such a manner that they count only up to the count "12," so that they are switched back to the starting condition "1" when a thirteenth counting pulse arrives. The second part of the tone address counter TAZ is made up of three series-connected counting stages which are connected so that the highest count corresponds to the number q of the octaves provided in the keyboard M. The second part of the counter TAZ receives its counting pulses always when the first part of the counter TZA changes to the count "1."

It should be noted that each time a "1" is read out from the shift register PSW, the corresponding count of both parts of the tone address counter TAZ is decoded and is stored temporarily in a memory S, provided in each of the channels $V_i$, with respect to the tone address, and in one of the memories S* with respect to the octave played. A prerequisite therefor is that the respective output channel $V_i$ be enabled by the channel selector KW for control by the "1" delivered by the shift register PSW. Then, the name of the tone of the key belonging to the "1" just leaving the shift register PSW is stored in the write-read memory S, and the number of the corresponding octave, always in the form of the then present count of the two parts of the tone address counter, is stored in the right-read memory S*. Each of the thus-provided channels $V_i$ terminates in an amplitude former $AF_i$, which serves for improving the sound. The total number of the channels $V_i$ and the amplitude formers $AF_i$ provided is, for example, $n=10$. In FIG. 1, only the first two channels $V_1$ and $V_2$ and the corresponding amplitude formers $AF_1$ and $AF_2$ are shown.

Further parts of a semiconductor circuit according to the aforementioned co-pending application, which are also important for the invention of the instant application are found in FIG. 2 herein which must first be discussed in preparation for describing the invention of the instant application.

The first memory S in the individual channels, which serves to receive the four-bit word forming the tone address within the individual octave, is formed of four individual shift register cells, particularly of the quasi-static type, which are evaluated in parallel operation via the decoder D, a "one-of twelve decoder." To the first decoder D, which has twelve signal outputs corresponding to the twelve tone names c, c-sharp, d, d-sharp, and so forth, there is accordingly assigned, per signal output, a respective AND gate $U_1$ and $U_2 \ldots U_{12}$, respectively, which together form a first group of AND gates. Each of these AND gates has two inputs, of which the first is connected to a respective one of the inputs of the decoder D and the second is connected to a respective one of the twelve tone inputs TSE of the circuit. The twelve tone signal inputs (audio signal inputs) TSE are addressed in turn by a respective one of the audio frequency outputs of the tone frequency generator TOS in the form of square waves with the levels "1" and "0" and having the respective frequency. The output of each of the AND gates $V_1$ to $V_{12}$ is connected to a respective input of a common OR gate O.

Due to the respective content of the first memory S addressing the decoder D, only one of the twelve outputs of the decoder D receives a "1," while the other outputs remain at "0."

Accordingly, there appears at the output of the aforementioned OR gate O, the audio frequency supplied by the tone generator TOS via the tone signal input TSE associated with the respective decoder output, according to the tone corresponding to the depressed key, the tone, however, always belonging to the highest octave.

The second memory S* is addressed by a binary word which is supplied by the second part of the tone address counter TAZ and represents the number of the octave containing the depressed key, and likewise controls, in parallel, an "1-of-q decoder" D*, where q is the number of octaves provided in the keyboard M. If, for example, n=6, the decoder D* is constructed as an "1-of-6 decoder" and has accordingly, six signal outputs. Each of the outputs of the second decoder D* responsible for the address of the octoave is again connected to a respective AND gate $U_1$* to $U_q$*, each of which has two inputs. The second input of each of these AND gates $U_1$* to $U_q$* i.e. of a second group of AND gates, is not controlled directly by the tone signal inputs TSE, like the AND gates of the first group. Rather, the aforementioned first OR gate O and a frequency divider TT following the latter serve for addressing the AND gates of the second with the required tone frequencies.

The frequency divider TT formed of q−1 divider stages, receives the tone signals to be processed thereby from the output of the first OR gate O, which is additionally provided for the direct addressing of the second input of the first AND gate $U_1$* connected to the first output of the second decoder D* of the second group of AND gates. The other AND gates of the second group, namely, the AND gates $U_2$* to $U_q$*, on the other hand, are connected by the second output thereof to the output of the first divider stage and the second divider stage, respectively, and so forth, respectively . . . and the (q−1)-th divider stage of the frequency divider TT, respectively. The association of the AND gates $U_1$* to $U_q$* and, therefore, of the outputs of the second decoder D* to the output of the OR gate O and the outputs of the frequency divider TT is made so that if one of these AND gates $U_j$* of the second group is addressed, exactly the tone frequency which corresponds to the number j of the associated octave, which is otherwise set by a respective one of the AND gates $U_1$ to $U_{12}$, is passed. It then appears at the output of the second OR gate O*, which is addressed by the outputs of the AND gates $U_j$* of the second group i.e. of the AND gates $U_1$* to $U_q$*.

The embodiment described in the aforementioned co-pending application provides q octaves, to which, respectively, twelve keys of the keyboard M are assigned, so that the keyboard M has 12q keys. If, for example, q=5, then the keyboard M accordingly has 60 keys, to each of which exactly one tone is assigned.

It presents no difficulty to expand the divider TT if an expansion of the tone range of the organ is intended. A therewith connected expansion of the keyboard M and the input parts of the circuit is considerably more expensive. It is therefore important to have a possibility available which permits an expansion of the tone range and which can be implemented without such an expansion of the keyboard M and the input parts of the circuit. It is accordingly an object of the invention to provide an improved digital semiconductor circuit of an electronic organ which realizes an expansion of the tone range of the organ in a relatively simple manner.

The invention of the instant application thus relates to a digital semiconductor circuit for an electronic organ having a plurality of control inputs, addressed via a keyboard, corresponding to the number of keys of the organ keyboard, as well as having a plurality of audio frequency signal inputs addressed by an oscillator system with periodic electrical oscillations, each control input being associated with a respective key of the keyboard and each audiofrequency signal input being permanently associated with a respective tone or audio frequency of the highest octave of the organ; the control signals serving to address the control inputs by the keys of the keyboard corresponding to the logical levels "1" and "0;" the individual control inputs being associated with a respective cell of a clock-controlled shift register PSW which is operated as a parallel-to-series converter, and the signal output of the shift register as well as clock pulses applied for the operation thereof being provided for controlling a switching system having a totality of the provided audiofrequency signal inputs as well as having a totality of the audiofrequency signal outputs, each of the audiofrequency signal outputs controlling an amplitude former and being less in number than that of the control inputs; two memories, respectively, being associated with each of the audiofrequency signal outputs of the switching system and each of these memories being followed by a respective decoder, the totality of the amplitude formers being provided for controlling at least one electroacoustic transducer; a tone address counter provided with counting pulses from shift pulses of the shift register for addressing the respective pair of memories associated with the individual audiofrequency signal outputs in such a manner that a first one of the memories and a following first decoder is associated with evaluation of the tone name, and a second one of the memories as well as a following second decoder is associated with evaluation of the octave of the tone information associated with the respective audiofrequency signal, based upon the action of the switching system, and deriving from the keyboard of the organ; each of the outputs of the respective first decoder associated with the individual audiofrequency signals being tied together with a respective one of the provided audiofrequency signal inputs and each of these audiofrequency signal inputs with one of the provided outputs of the first decoder via a respective AND gate belonging to a first group of AND gates, and the outputs of the first group of AND gates being tied together via a common first OR gate, and a frequency divider and a second group of AND gates, with the frequency divider partly interposed, being controlled by the first OR gate, the second input of the individual AND gates being addressed by the individual outputs of the second decoder, in accordance with the hereinaforementioned co-pending application. More specifically in accordance with the features of the invention of the instant application, the frequency divider has a number t of divider states at least equal to a number q of the octaves provided in the keyboard of the organ, and a number u of the AND gates provided in the second group of AND gates is greater than the number q of the octaves provided in the keyboard of the organ; all of the AND gates of the second group having a third signal input; and at least one setting input connectible by an individual playing the organ via a switch to the level logic "1" for addressing the third signal inputs of these AND gates.

Through such an expansion of the circuits described in the aforementioned previously filed co-pending application, the organ player, by actuating the setting switch which connects the respective setting input to the level "1" or disconnects it therefrom, can ensure that, during a first operating mode of the setting input, the outputs of the second decoder D* are controlled via a respective AND gate of the second group associated with the outputs of the second decoder D* in a manner apparent from the aforementioned co-pending application, while in the second operating state, set via the setting switch, the outputs of the second decoder are tied together with the outputs of the divider stages FF of the frequency divider TT in such a manner that the same outputs of the second decoder D* are then tied together with a respective divider stage which is associated with the next-lower octave, in comparison with the first operating mode of the setting input, so that a tone lower by one octave is generated by the same key. This last-mentioned tone appears at the output of an AND gate of the second group of AND gates which is not in operation during the first operating mode, while the AND gates of the second group activated during the first operating mode can then no longer be activated by the second decoder D*.

The just-described possibility of operating a circuit corresponding to that of the invention is already provided if the number of divider stages in the divider TT is equal to the number q of the octaves provided in the organ keyboard and, therefore, equal to the number of outputs of the second decoder D*. If the number of divider stages is even greater, it is possible, without difficulty or major expense to modify the circuit in such a way that the addressing by the keyboard M can be shifted by two or more octaves in direction toward lower tones, as desired or required. By providing the setting switch associated with one of the provided setting inputs in the form of a toggle switch at the control console of the organ next to the keyboard, such a shift can be made without difficulty even while playing.

In accordance with another feature of the invention, the number u of the AND gates of the second group is equal to the product of the total number q of the outputs of the second decoder D* by the total number p of setting inputs; the same number of the AND gates, respectively, of the second group being connected to each of the setting inputs; and the number p of the setting inputs being matched to the number t of the provided divider states FF in the frequency divider TT in such a menner that $p=(t-q)$ applies, the same number u:q of AND gates of the second group, respectively, being associated with each of the q outputs of the second decoder D*.

In accordance with a further feature of the invention, the outputs of the first OR gate O and the divider stages FF of the frequency divider TT are interlinked with the individual outputs of the second decoder D* and the individual setting inputs by the AND gates of the second group so that, upon the appearance of a "1" at a respective one of the outputs of the decoder D*, an audiofrequency signal reaches the output of the second OR gate O* controlled by the outputs of the totality of the AND gates of the second group, the frequency of the audiofrequency signal being all the lower, the higher the number of the respective decoder output and the higher the number of the setting input which enables the appearance of the audiofrequency signal.

In accordance with additional features of the invention, the output of the first OR gate O is interlinked only with one output 1 of the second decoder D* associated with the highest octave in the keyboard as well as with the setting input $S_1$ having the lowest subscript number, and the output of the last divider stage FF of the frequency divider is interlinked only with another output 5 of the second decoder D* associated with the lowest octave in the keyboard and with the setting input $S_3$ having the highest subscript number; the output of the first divider stage FF in the frequency divider as well as the output of the next-to-the-last divider stage FF of the frequency divider TT being interlinked with two outputs of the second decoder D* as well as with two setting inputs, while the outputs of the remaining divider stages FF of the frequency divider TT are linked respectively with three outputs of the second decoder D* as well as with the three setting inputs, ony a single AND gate of the second group, respectively, being operatively connected between a respective one of the decoder outputs as well as a respective one of the participating setting inputs and the output of the respective divider stage FF; the coordination between the individual outputs 1 to 5 of the decoder D* and the setting inputs $S_i$ participating in the respective interlinkage being such that the number of the decoder output interlinked with the respective output of the divider TT is all the higher and, therefore, the octave from the keyboard associated with the respective decoder output is all the lower, the higher the subscript number i of the setting member $S_i$ interlinked therewith, the outputs of the second decoder AND-interlinked with the output of the respective divider stage being respectively associated with a coherent series of octaves in the keyboard which are all the lower, the farther the respective divider-stage is removed from the input of the divider TT addressed by the second OR gate O.

In accordance with yet another feature of the invention, the linkages between the outputs of the individual divider stages as well as the individual outputs of the second decoder D* and the setting inputs $S_i$, established via a respective AND gate of the second group are all different from one another, and the setting inputs $S_i$ are insertable singly as well as jointly.

In accordance with a concommitant features of the invention, the setting inputs $S_i$ are associated simultaneously with a plurality of mutually identical circuit parts, comprising a first and a second memory S and S*, respectively, a first and a second decoder D and D*, respectively, a respective frequency divider, a respective first group and a respective second group of AND gates as well as of a first and a second OR gate, and the respective output of the second OR gate O is identical with the audiofrequency signal output of a respective one of the provided channels $V_i$.

Other features which are considered as characteristic for the invention are set forth in the appended claims.

Although the invention is illustreated and described herein as embodied in a digital semiconductor circuit for an electronic organ, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
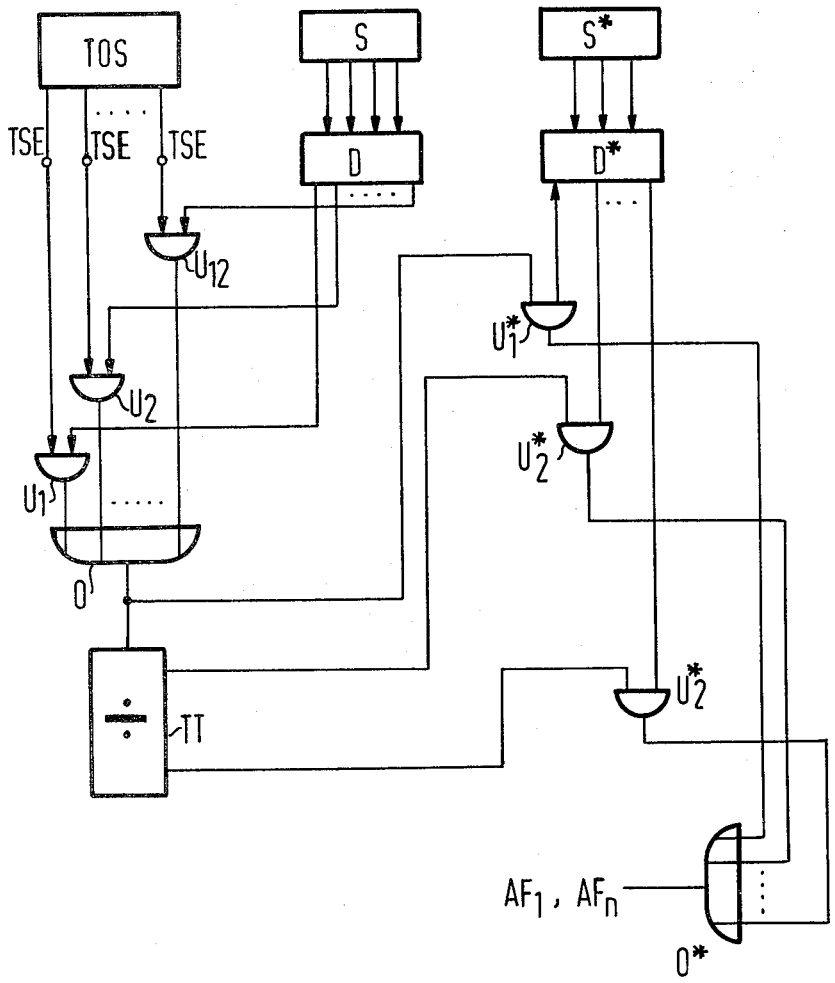
FIG. 2 is a block diagram providing further details of the circuit in FIG. 1.
Figure 3:
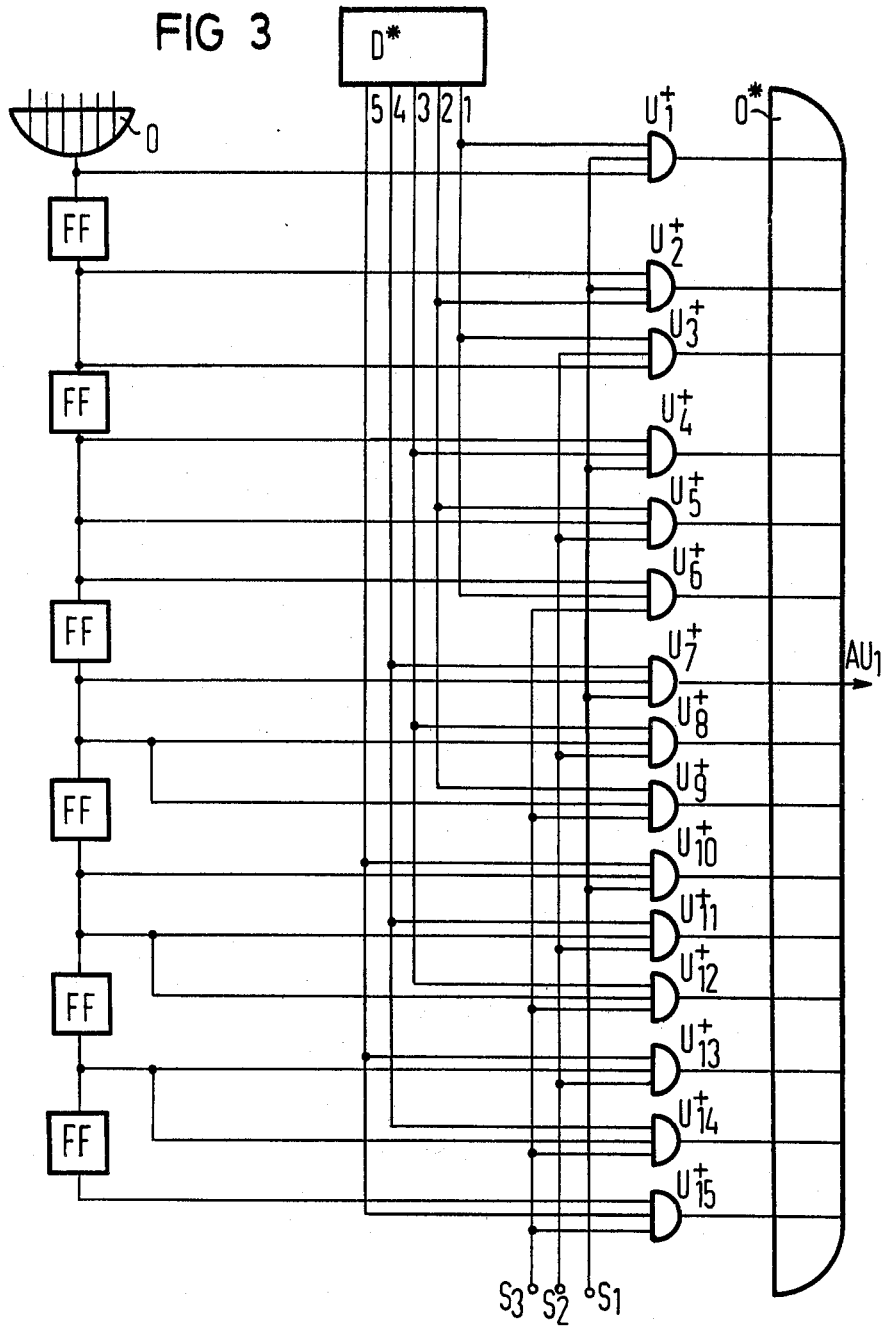
FIG. 3 is a block diagram showing details embodying the invention of the instant application.

Referring now to FIG. 3 of the drawing, there is shown therein an embodiment of the invention of the instant application. The number q of the outputs of the second decoder D* is shown equal to 5 in FIG. 3, so that, accordingly, five octaves are provided in the keyboard of the organ. Of the circuit parts according to FIG. 2, only the first OR gate O, the second OR gate O* as well as the divider TT and the required AND gates of the second group in their totality are shown in FIG. 3, while the circuit parts shown in FIG. 1 have been completely omitted from FIG. 3.

The number of the divider stages FF is given in the embodiment shown in FIG. 3 by t=6, so that together with the output of the first OR gate, seven terminals are available, each of which supplies the audiofrequencies of one octave, so that a total of 7 octaves are available, although only keys for five octaves are actually available in the keyboard M of the organ. The individual divider stages FF may be provided, for example, by respective toggle flipflop. The number of AND gates $U_s+$ of the second group of AND gates is 15, each of which, according to the invention, is equipped with three signal inputs.

The circuit shown in FIG. 3 has, in addition, three setting inputs $S_1$, $S_2$ and $S_3$ which can be connected by a non-illustrated setting switch to the level logic "1." (The level "1" may be provided by the supply potential $V_{DD}$, if the circuit is realized in n-channel MOS technology). The individual AND gates $U_{15}+$ are connected in a manner shown in FIG. 3.

The AND gates $U_1+$, $U_3+$ and $U_6+$ are connected to the output 1 of the second decoder D* and are accordingly operatively associated with the keys belonging to the highest octave in the keyboard M. AND gates $U_2+$, $U_5+$ and $U_9+$, are connected to the output 2 of the decoder D* associated with the next-highest octave in the keyboard, AND gates $U_4+$, $U_8+$ and $U_{12}+$, to the output 3 of the decoder D* associated with the third-highest octave, and AND gates $U_7+$, $U_{11}+$ and $U_{14}+$ to the decoder output 4 associated with the fourth-highest octave, as well as AND gates $U_{10}+$, $U_{13}+$ and $U_{15}+$ to the decoder output 5.

With respect to supplying the hereinaforementioned fifteen AND gates $U_1+$ to $U_{15}+$ with tone or audio frequencies, it should be stated that, by the output of the first OR gate O, only a single one of the aforementioned AND gates, namely the AND gate $U_1+$ connected to the output 1 of the decoder D*, is controlled directly, while the AND gates $U_2+$ to $U_{15}+$ are addressed exclusively with the divider TT interposed. The latter has six divider states FF.

The AND gates $U_2+$ and $U_3+$ are connected to the output of the first divider stage, and AND gates $U_4+$, $U_5+$ and $U_6+$ are connected to the output of the second divider stage, the AND gates $U_7+$, $U_8+$ and $U_9+$ are connected to the output of the third divider stage, the AND gates $U_{10}+$, $U_{11}+$ and $U_{12}+$ are connected to the output of the fourth divider stage, the AND gates $U_{13}+$, $U_{14}+$ are connected to the output of the fifth divider stage, and the AND gate $U_{15}+$ is connected to the output of the sixth divider stage.

Finally, the first setting input $S_1$ serves for controlling the AND gates $U_1+$, $U_2+$, $U_4+$, $U_7+$, $U_{10}+$, the second setting input $S_2$ serves for controlling the AND gates $U_3+$, $U_5+$, $U_8+$, $U_{11}+$, $U_{13}+$, and the third setting input $S_3$ serves for controlling the AND gates $U_6+$, $U_9+$, $U_{12}+$, $U_{14}+$ and $U_{15}+$ with the level logical "1."

Figure 1:
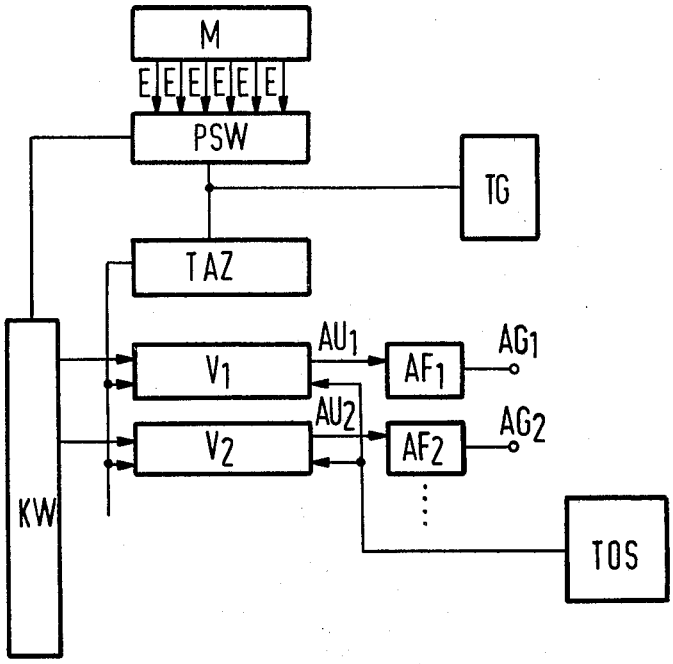
FIG. 1 is a block diagram showing basic parts of a digital semiconductor circuit for an electronic organ according to co-pending application Ser. No. 210,373 filed Nov. 26, 1980.

The outputs of the individual AND gates $U_1+$ to $U_{15}+$ are each connected to an input of the second OR gate O*, the output of which forms one of the tone or audiofrequency signal outputs $AU_i$ of a respective one of the provided channels $V_i$ in the switching system according to FIG. 1 and accordingly serves for controlling one of the provided amplitude formers $AF_i$.

It should be noted that, with each of the output channels $V_i$ of the circuit shown in FIG. 1, a respective expansion of extension circuit shown in FIG. 3, according to the invention, is operatively associated. The setting inputs $S_i$ with the same subscript number i, that is, the setting inputs $S_1$ on the one hand, the setting inputs $S_2$ on the other hand, and the setting inputs $S_3$, in turn, are connected to one another, so that they can be addressed together by a single assigned setting switch, respectively, with the level "1." It should further be noted that it may be advisable if a setting input $S_1$ is switched to the level "1," to bring the remaining setting inputs (for example, automatically) to the level "0" or to maintain it there, respectively.

The operation of the circuit according to FIG. 3 will be readily understood when viewing the figure. If a "1" is present at the setting input $S_1$ and the level "0" at two other setting inputs $S_2$ and $S_3$, then the five outputs 1 to 5 of the second decoder D* are linked via a respective one of the AND gates $U_1+$, $U_2+$, $U_4+$, $U_7+$ and $U_{10}+$ to the output of the first OR gate "O" or the output of a respective one of the first divider stages FF of the divider TT, so that the tones of the five highest octaves are provided when the keyboard M is actuated. If, on the other hand, the level "1" is present at the setting input $S_2$, then the five outputs of the decoder D* are combined via a respective one of the five first divider stages FF of the divider TT. If, finally, the level "1" is present at the setting input $S_3$, then the five outputs of the decoder D* are connected via a respective one of the AND gates $U_6+$, $U_9+$, $U_{12}+$, $U_{14}+$ and $U_{15}+$ to one of the five last stages FF of the divider TT. It is thus apparent that two additional octaves are available, which can be played from the keyboard M. It is clear that it is determined via the setting inputs $S_1$, $S_2$ and $S_3$ as to which of the tone signals appearing at the output of the first OR gate O or the outputs of the divider stages FF of the divider TT, respectively, can reach the second OR gate O* and, therefore, the output $AU_i$ of the channel $V_i$ containing the supplementary circuit according to the invention if addressed by the second decoder D* and thereby the keyboard M.

A supplementation of a digital semiconductor circuit according to the hereinaforementioned previously co-pending patent application which is in accordance with the invention of the instant application can be effected without difficulty. In general, the number of AND gates $U_s+$ is selected equal to the product of the total number of outputs q of the second decoder D* and the total number p of the setting inputs $S_1$, where the same number of AND gates $U_s+$ is applied to the individual setting input. The number p of setting inputs $S_1$ is furthermore matched to the number t of the provided divider stages FF of the frequency divider TT in such a manner that $(t+1-q)=(p-1)$. With each of the q outputs of the second decoder D*, there is further associated with the same number u:q of AND gates of the second group, u being the total number of these AND gates.

With respect to linking the outputs of the second decoder D* to the output of the first OR gate O and the individual outputs of the frequency divider TT, respectively, one will note, in agreement with the circuit shown in FIG. 3 that, regardless of the respective setting by the setting inputs $S_i$, a tone or audiofrequency signal always appears at the output of the second OR gate O* when a "1" appears at each of the outputs of the decoder D*, the frequency of that audiofrequency signal being all the lower, the higher the number of the respective decoder output and, therefore, all the lower the frequency associated with the respective decoder output in the keyboard M is, the higher the number i of the setting input $S_i$ which makes the appearance of the tone signal possible.

In order to achieve this, the output of the first OR gate O is linked only to a single output of the decoder D* i.e. to the output 1 via a single AND gate $U_1+$, which is co-controlled by the first setting input $S_1$. Furthermore, the output of the first divider stage FF serves for addressing two AND gates $U_2+$ and $U_3+$ of which the first-mentioned belongs to the setting input $S_1$ and to the decoder output 2, and the second-mentioned belongs to the setting input $S_2$ and the decoder output 1. The output of the third divider stage and the outputs of the other divider stages are always interlinked with the provided setting inputs $S_i$ and the individual outputs of the second decoder D* in such a manner that, with the exception of the output of the two last divider stages, each divider stage can be combined with three outputs of the decoder D*, while such a combination of the next to the last divider stage with only two outputs of the decoder D* and, in the case of the last divider stage, only an interlinkage with only one output of the decoder D* is possible. In this regard, the coordination between the individual outputs of the decoder D* and the individual setting inputs $S_i$ is effected for all interlinkages in such a manner that the number of the decoder output interlinked with the respective output of the divider TT is all the higher, the lower the number i of the setting input $S_i$ participating in the interlinkage. Because, in the case of the output of the first OR gate O or the last divider stage, respectively, only one interlinking possibility is provided, it need only be noted at this juncture that the last divider stage is interlinked with the decoder output having the highest number as well as with the setting input $S_i$ having the highest subscript number i, while in the case of the output of the first OR gate O, only an interlinkage with the lowest number i, i.e. the setting input $S_1$ carrying the lowest subscript number 1 and the decoder output having the lowest number i.e. the number 1, is provided. It should finally be noted that the tying of the individual outputs of the divider TT to the individual outputs of the decoder D* is effected so that the outputs of the decoder D*, which can be interlinked with the output of each of the divider stages, are associated exclusively with directly succeeding octaves of the keyboard M and therefore form a successively numbered series of numbers. These considerations apply also to an expansion of the circuit shown in FIG. 3 to more than six divider stages FF and more than five outputs of the decoder D*.

Independently of an expansion circuit constructed in accordance with the invention, there are yet further possibilities for expanding the toen or audiofrequency range of the electronic organ employing a circuit in accordance with the aforementioned previously filed co-pending application. Thus, for example, the decoder D* may be enlarged and the octave address recalculated prior to decoding i.e. a constant may be added. It is also possible to preset the tone address counter TAZ, for example, using a preset (instead of a reset) with this constant. Finally, there is also a possibility of placing, between the output of the first OR gate O and the input of the correspondingly enlarged frequency divider TT, a frequency divider circuit which can be controlled by setting switches in such a manner that, depending upon the position of the divider circuit, different tone or audio frequencies arrive at the AND gates $U_1+$ and $U_2+$ described in the aforementioned prior copending application and shown in FIG. 2. It would appear, however, that the embodiment described hereinbefore in connection with FIG. 3 is the optimum solution and, consequently, the best mode of practicing the invention.

There is claimed:

1. In a digital semiconductor circuit for an electronic organ having a plurality of control inputs addressed via a keyboard and corresponding in number to the number of keys of the organ keyboard, and a plurality of audiofrequency signal inputs addressed with periodic electrical oscillations by an oscillator system, each control input being associated with a respective key of the keyboard and each audiofrequency signal input being permanently assigned with a respective tone frequency of the highest octave of the organ; the control signals serving to address the control inputs by the keys of the keyboard corresponding to the logical levels "1" and "0"; the individual control inputs being associated with a respective cell of a clock-controlled shift register which is operated as a parallel-to-series converter, and the signal output of the shift register as well as clock pulses applied for the operation thereof being provided for controlling a switching system having as inputs a totality of the audiofrequency signal inputs and also having a totality of audiofrequency signal outputs, the audiofrequency signal outputs respectively controlling an amplitude controller and being less in number than the number of the control inputs; two memories, respectively, being associated with each of the audiofrequency signal outputs of the switching system and each of the memories being followed by a respective decoder; a tone address counter provided with counting pulses from the shift pulses of the shift register for addressing the respective pair of memories associated with the individual audiofrequency signal outputs in such a manner that a first one of the memories and a following first decoder are associated with evaluation of the tone name, and a second one of the memories, as well as a following second decoder, is associated with evaluation of the octave of the tone information associated with the respective audiofrequency signal based upon the action of the switching system, and deriving from the keyboard of the organ; each of the outputs of the respective first decoder associated with the individual audiofrequency signals being tied together with a respective one of the provided audiofrequency signal inputs and each of these audiofrequency signal inputs with one of the provided outputs of the first decoder via a respective AND gate belonging to a first group of AND gates, and the outputs of the first group of AND gates being tied together via a common first OR gate, and a frequency divider and a second group of AND gates being controlled by the first OR gate, the second input of the individual AND gates of said second group thereof being addressed by the individual outputs of the second decoder, the improvement therein comprising a number t of divider stages in the frequency divider at least equal to a number q of the octaves provided in the keyboard of the organ, and a number u of the AND gates provided in the second group of AND gates being greater than the number q of the octaves provided in the keyboard of the organ; all of the AND gates of the second group having a third signal input; and, at least one setting input connectible by an individual playing the organ via a switch to the logical level "1," for addressing said third signal inputs of these AND gates.

2. Semiconductor circuit according to claim 1, including a total number p of setting inputs and wherein said number u of the AND gates of the second group is equal to the product of said total number q of the outputs of the second decoder by said total number p of setting inputs; a given number of the AND gates, respectively, of the second group being connected to one of the setting inputs and a number of the AND gates, respectively, of the second group equal to said given number being connected to each of the other setting inputs; and said number p of the setting inputs being matched to said number t of the provided divider stages FF in the frequency divider TT in such a manner that $p=(t=q+2)$ applies, a given number of AND gates of the second group, respectively, being associated with one of said q outputs of the second decoder and a number of AND gates of the second group, respectively, equal to said given number being associated with each of the other of outputs of the second decoder.

3. Semiconductor circuit according to claim 1 wherein the outputs of the first OR gate O and the divider stages FF of the frequency divider TT are interlinked with the individual outputs of the second decoder D* and the individual setting inputs by the AND gates of the second group so that, upon the appearance of a "1" at a respective one of the outputs of the decoder D*, an audiofrequency signal reaches the output of the second OR gate O* controlled by the outputs of the totality of the AND gates of the second group, the frequency of said audiofrequency signal being lower, the higher the number of the respective decoder output and the higher the number of the setting input which enables the appearance of said audiofrequency signal.

4. Semiconductor circuit according to claim 2, wherein the output of the first OR gate O is interlinked only with one output 1 of the second decoder associated with the highest octave in the keyboard as well as with the setting input $S_1$ having the lowest subscript number, and the output of the last divider stage FF of the frequency divider TT is interlinked only with another output 5 of the second decoder associated with the lowest octave in the keyboard and with the setting input $S_3$ having the highest subscript number; the output of the first divider stage FF in the frequency divider TT as well as the output of the next-to-the-last divider stage FF of the frequency divider TT being interlinked with two outputs of the second decoder as well as with two setting inputs, while the outputs of the remaining divider stages FF of the frequency divider TT are linked respectively with three outputs of the second decoder D* as well as with three setting inputs, only a single AND gate of the second group, respectively, being operatively connected between a respective one of the decoder outputs as well as a respective one of the participating setting inputs and the output of the respective divider stage FF; the coordination between the individual outputs 1 to 5 of the second decoder and the setting inputs $S_i$ participating in the respective interlinkage being such that the number of the decoder output interlinked with the respective output of the divider TT is higher and, therefore, the octave from the keyboard associated with the respective decoder output is lower, the higher the subscript number i of the setting member $S_i$ interlinked therewith, the outputs of the second decoder interlinked via an AND gate with the output of the respective divider stage being respectively associated with a coherent series of octaves in the keyboard which are lower, the farther the respective divider stage is removed from the input of the divider TT addressed by the second OR gate O.

5. Semiconductor circuit according to claim 4, wherein the linkages between the outputs of the individual divider stages FF as well as the individual outputs of the second decoder and the setting inputs $S_i$, established via a respective AND gate of the second group are all different from one another, and the setting inputs $S_i$ are insertable singly as well as jointly.

6. Semiconductor circuit according to claim 5 wherein said setting inputs $S_i$ are associated simultaneously with a plurality of mutually identical circuit parts, comprising a first and a second memory S and S*, respectively, a first and a second decoder and, respectively, a respective frequency divider, a respective first group and a respective second group of AND gates as well as a first and a second OR gate, and the respective output of said second OR gate is identical with the audiofrequency signal output of a respective one of a plurality of channels $V_i$ of the switching system.

* * * * *